US005153089A

United States Patent [19]

Ong et al.

[11] Patent Number: 5,153,089

[45] Date of Patent: Oct. 6, 1992

[54] ENCAPSULATED TONER COMPOSITIONS AND PROCESSES THEREOF

[75] Inventors: Beng S. Ong, Mississauga; Walter Mychajlowskij, Georgetown; Guerino G. Sacripante, Oakville; Grazyna Kmiecik-Lawrynowicz, Burlington, all of Canada

[73] Assignee: Xerox Corporation, Stamford, Conn.

[21] Appl. No.: 782,688

[22] Filed: Oct. 25, 1991

[51] Int. Cl.[5] ..... G03G 9/093; G03G 13/22

[52] U.S. Cl. ..... 430/110; 430/109; 430/124; 430/137; 430/138

[58] Field of Search ..... 430/109, 110, 137, 138, 430/124

[56] References Cited

U.S. PATENT DOCUMENTS

| | | | |
|---|---|---|---|
| 3,720,617 | 3/1973 | Chatterji et al. . | |
| 3,819,367 | 6/1974 | Chatterji et al. . | |
| 3,983,045 | 9/1976 | Jugle et al. . | |
| 4,565,758 | 1/1986 | Tachiki et al. | 430/58 |
| 4,626,489 | 12/1986 | Hyosu | 430/137 |
| 4,868,084 | 9/1989 | Uchide et al. | 430/110 |
| 5,023,159 | 6/1991 | Ong et al. | 430/138 X |
| 5,043,240 | 8/1991 | Ong et al. | 430/109 |
| 5,104,763 | 4/1992 | Ong et al. | 430/138 X |

FOREIGN PATENT DOCUMENTS

| | | | |
|---|---|---|---|
| 123853 | 7/1984 | Japan | 430/137 |
| 152452 | 8/1984 | Japan | 430/137 |
| 34555 | 2/1986 | Japan | 430/137 |

*Primary Examiner*—Roland Martin
*Attorney, Agent, or Firm*—E. O. Palazzo

[57] ABSTRACT

A toner composition comprised of a homogeneous or substantially homogeneous mixture of polymer resin or resins, and color pigments, dyes, or mixtures thereof overcoated with a component derived from the condensation of a cellulose polymer with a silane component.

20 Claims, No Drawings

ENCAPSULATED TONER COMPOSITIONS AND PROCESSES THEREOF

BACKGROUND OF THE INVENTION

The present invention is generally directed to toner compositions and processes for the preparation thereof, and more specifically to toner compositions and chemical preparative processes for directly generating silane-modified toner particles of small particle size and narrow particle size distribution without resorting to conventional pulverization and classification methods. In one embodiment, the present invention relates to processes for preparing small sized spherical toner particles comprised of a polymer resin or resins, and colorants comprising color pigments, dyes, or mixtures thereof, dispersed homogeneously or substantially homogeneously throughout the polymer resin or resins, and wherein the toner has been coated with a layer of a cellulose derivative component generated from the reaction of a suitable silane reagent with the cellulose molecules on the toner's surface. The silane modification of the cellulose surface layer enhances the toner's powder flow characteristics, and eliminates or substantially reduces the toner's sensitivity to humidity changes.

The toner particles of the present invention can be prepared in embodiments by a simple one-pot process which comprises (1) forming a stable oil-in-water microdroplet suspension by dispersing with high sheer blending a mixture of addition monomers, free radical initiators, colorants, and optional preformed polymers in an aqueous cellulose surfactant solution containing an optional inorganic surfactant; (2) converting the microdroplets into polymer toner particles by polymerizing the addition monomers via free radical polymerization; and (3) treating the resulting toner particles with suitable silane reagents, affording the silane-modified toner particles of the present invention. It is believed that during the dispersion step, the cellulose surfactant molecules adsorb and precipitate on the microdroplets, forming a thin microcapsule coating around the microdroplets. The cellulose surface coating inhibits the droplet-to-droplet coalescence, and enables the attainment of narrow droplet size distributions. The encapsulation of microdroplets by the cellulose surfactant molecules also facilitates subsequent free radical polymerization without the complications of suspension failure which is commonly observed in suspension polymerization. Also, the silane-modified cellulose shell renders the toners of the present invention relatively hydrophobic, and they are therefore in embodiments not sensitive, or substantially insensitive to changes in relative humidity. In addition, the silane-modified cellulose shell can serve to protect the toner components such as polymer resins and colorants, thereby isolating them from the adverse effects of their environment. Another attribute of the protective silane-modified cellulose coating relates to the complete, or substantially complete nullification or passivation of the charging effects of colorants present in the toners. Accordingly, for two-component development where toner particles are admixed with carrier particles, the triboelectric properties of toners are thereby controlled or substantially dominated by the charging effects of the outer silane-modified cellulose coating. The passivation of the charging effects of colorants is particularly important for multi-color xerography, since similar or substantially similar equilibrium triboelectric characteristics can be readily achieved with these toners regardless of the nature of the colorants present in the toners. For single component development where triboelectric charging is generally accomplished by a frictional charging blade, similar equilibrium triboelectric charge levels can also be obtained with different colored toners of the present invention under identical, or substantially similar conditions. Furthermore, effective containment of the toner components enabled by the silane-modified cellulose coating of the present invention prevents these components from leaching to the toner's surface, thereby eliminating or substantially reducing the problem of toner blocking or agglomeration in toners wherein, for example, toner resins of low glass transition temperatures are utilized.

In color reprography, such as in full color or highlight color processes, colored toners with a wide variety of colors including black are usually employed. For two-component development, it is highly desirable that the triboelectric properties of different colored toners be controlled, thereby permitting them to attain similar equilibrium triboelectric charging levels when utilized with the same carriers. This is especially useful for custom colored toner packages which can be generated by the simple blending of the primary colored toners of the present invention. Another important aspect of two-component development is the rate of charging of fresh, substantially uncharged toners to equilibrium charge levels when added to the toner depleted development housing. A fast rate of charging of fresh toners is important in ensuring proper image development, particularly for high speed reprographic systems. These and other advantages are achieved with the toners of the present invention.

Colorants such as color pigments or dyes have a dominant effect on the triboelectric charging behavior of toners as the colorants are often present at or close to the surface of the toner, and are, therefore, exposed to the environment. As a consequence, when the toner particles are admixed with carriers, the interactions of the exposed pigments of the toners with the carrier particles can affect, and often dominate the charging behavior of the toner. This can also occur for a number of prior art encapsulated toners where the color pigment particles are not completely encapsulated within the toner shell. Accordingly, toners with identical, or substantially similar components, but different colorants, often exhibit different charging behavior, sometimes to the extent of achieving triboelectric charges of opposite polarity. To overcome this difficulty, it is usually necessary to utilize different triboelectric charge control additives for different colorants or to incorporate a high level of charge control additives into the toner to nullify or overcome the different charging effects of different colorants. The toners of the present invention eliminate or substantially overcome this difficulty. As a consequence, the need to rely on different or high levels of charge control additives for different colored toners for achieving similar triboelectric charging levels is eliminated or substantially avoided with the toners and processes of the present invention.

Encapsulated toners and processes are known. For example, both U.S. Pat. No. 4,626,489 and British Patent 1,538,787 disclose processes for the preparation of colored encapsulated toners wherein both the core resin and shell materials are prepared by suspension polymerization techniques. U.S. Pat. No. 4,565,764 discloses a colored microcapsule toner comprised of a colored core encapsulated by two resin shells with the inner shell having an affinity for both the core and the outer shell; and U.S. Pat. No. 4,254,201 illustrates the use of pressure sensitive toner clusters or aggregates with each granule of the cluster or aggregate being comprised of a pressure sensitive adhesive substance encapsulated by coating film. Color pigment particles or magnetic particles can be present on the surfaces of the encapsulated granules to impart the desired color to the toners. Also, U.S. Pat. No. 4,727,011 discloses a process for preparing encapsulated toners which involves a shell forming interfacial polycondensation and a core binder forming free radical polymerization, and further U.S. Pat. No. 4,708,924 discloses the use of a mixture of two polymers, one having a glass transition temperature in the range of −90° C. to 5° C., and the other having a softening temperature in the range of 25° C. to 180° C., as the core binders for a pressure fixable encapsulated toner. Other prior art, all United States patents, are summarized below: No. 4,339,518, which relates to a process of electrostatic printing with fluorinated polymer toner additives where suitable materials for the dielectric toner include thermoplastic silicone resins and fluorine containing resins having low surface energy, reference column 4, beginning at line 10, note for example the disclosure in column 4, line 16, through column 6; No. 4,016,099, which discloses methods of forming encapsulated toner particles and wherein there are selected organic polymers including homopolymers and copolymers such as vinylidene fluoride, tetrafluoroethylene, chlorotrifluoroethylene, and the like, see column 6, beginning at line 3, wherein there can be selected as the core materials polyolefins, polytetrafluoroethylene, polyethylene oxide and the like, see column 3, beginning at around line 18, No. 4,265,994 directed to pressure fixable capsule toners with polyolefins, such as polytetrafluoroethylene, see for example column 3, beginning at line 15; No. 4,497,885, which discloses a pressure fixable microcapsule toner comprising a pressure fixable component, a magnetic material, and other optional components, and wherein the core material can contain a soft material, typical examples of which include polyvinylidene fluoride, polybutadiene, and the like, see column 3, beginning at line 10; No. 4,520,091 which discloses an encapsulated toner with a core which comprises a colorant, a dissolving solvent, a nondissolving liquid and a polymer, and may include additives such as a fluorine containing resin, see column 10, beginning at line 27; No. 4,590,142 relating to capsule toners wherein additives such as polytetrafluoroethylenes are selected as lubricating components, see column 5, beginning at line 52; and Nos. 4,599,289 and 4,803,144.

With further specific reference to the prior art, there are disclosed in U.S. Pat. No. 4,307,169 microcapsular electrostatic marking particles containing a pressure fixable core, and an encapsulating substance comprised of a pressure rupturable shell, wherein the shell is formed by an interfacial polymerization. One shell prepared in accordance with the teachings of this patent is a polyamide obtained by interfacial polymerization. Furthermore, there are disclosed in U.S. Pat. No. 4,407,922 pressure sensitive toner compositions comprised of a blend of two immiscible polymers selected from the group consisting of certain polymers as a hard component, and polyoctyldecylvinylether-co-maleic anhydride as a soft component. Interfacial polymerization processes are also selected for the preparation of the toners of this patent. Also, there are disclosed in the prior art encapsulated toner compositions containing costly pigments and dyes, reference for example the color photocapsule toners of U.S. Pat. Nos. 4,399,209; 4,482,624; 4,483,912 and 4,397,483.

In a search report, there were located the following United States Patents as being of background interest and relating to the treatment of colloidal silica with silane coupling agents Nos. 3,720,617; 3,819,367; 3,983,045 and 4,868,084; and 4,565,758 which discloses the inclusion of a silane coupling agent in a photoreceptor.

The disclosures of all the United States patents and other patent documents mentioned herein are totally incorporated herein by reference.

A number of patents and copending applications illustrate various encapsulated toner compositions including, for example, U.S. Pat. No. 5,043,240, U.S. Pat. No. 5,035,970, U.S. Pat. No. 5,037,716, U.S. Pat. No. 5,045,428, U.S. Pat. No. 5,013,630, U.S. Pat. No. 5,023,159, U.S. Ser. No. 516,864, U.S. Pat. No. 5,077,167, U.S. Ser. No. 456,278, U.S. Pat. No. 5,114,819, U.S. Pat. No. 5,082,757, and U.S. Ser. No. 617,222, the disclosures of each of the aforementioned patents and copending applications being totally incorporated herein by reference.

SUMMARY OF THE INVENTION

It is a feature of the present invention to provide toner compositions with many of the advantages illustrated herein.

In another feature of the present invention there are provided toner compositions comprised of a core encapsulated in a thin triboelectric charge dominating layer.

In another feature of the present invention there are provided toner compositions comprised of a core comprised of a polymer resin or plurality of resins, colorants and optional triboelectric charge control additives, and thereover a silane-modified cellulose shell derived from treating a cellulose coating with certain silane reagents such as a trialkoxysilane, and wherein the triboelectric charging characteristics of colorants are passivated or substantially passivated.

It is still another feature of the present invention to provide color toners whose sensitivity to moisture is eliminated or substantially reduced.

Another feature of the present invention relates to the provision of colored toners which exhibit good powder flow characteristics without the use of surface flow additives.

A further feature of the present invention relates to the provision of nonblocking, free flowing colored toners.

An additional feature of the present invention is the provision of colored toners exhibiting low fusing properties, thus enabling a lowering of the toner fusing temperature.

A further feature of the present invention is to provide a simple direct process for the preparation of small sized colored toners with narrow particle size distribution without the need to resort to conventional pulverization and classification techniques.

An additional feature of the present invention resides in the provision of colored toner compositions comprised of a core containing a polymer resin derived from free radical polymerization, an optional preformed polymer resin, and colorants such as colored pigments or dyes with a wide spectrum of colors such as red, blue, green, brown, yellow, magenta, cyan, and mixtures thereof, and a silane-modified cellulose outer layer, and wherein the charging effects of the colorants present in the toners are passivated or substantially passivated.

These and other features of the present invention can be accomplished in embodiments by the provision of toners, and more specifically silane-modified cellulose coated toners and processes thereof. In one embodiment of the present invention, there are provided spherical toners with a core comprised of a polymer resin derived from the free radical polymerization of monomer, or a plurality of monomers, for example up to 3 to 4, an optional preformed polymer resin, and colorants such as color pigment, encapsulated within a cellulose coating having chemically attached thereto a silane derivative. In another embodiment there are provided, in accordance with the present invention, colored encapsulated toners comprised of a core comprised of a polymer resin derived from a free radical polymerization, an optional preformed polymer resin, and colorants excluding black; and a silane-modified cellulose shell.

In an embodiment of the present invention, the toners are comprised of a core comprised of a known polymer resin such as a styrene polymer, an acrylate polymer, a methacrylate polymer, and the like, and a colored pigment, encapsulated within a polymeric coating comprised of cellulose derivative having been chemically treated with certain silane reagents. The silane treatment of the cellulose coating reinforces, for example, its integrity and promotes its effectiveness in containing the core components, in particular color pigments, thus enabling passivation of their charging effects on the resultant toners, and permits improved toner powder flow characteristics.

The aforementioned toners of the present invention can be prepared by a process which comprises (1) dispersing a mixture of an addition monomer or monomers, an oil-soluble free-radical initiator, a colorant, an optional preformed polymer resin, such as a styrene polymer, an acrylate polymer, a methacrylate polymer, a polyester, and the like, present in an effective amount of, for example, from between about 0 to about 50 weight percent of the total core polymer resins, and an optional diluent, by high shear blending into stabilized microdroplets having a specific droplet size and size distribution in an aqueous cellulose surfactant solution containing an optional inorganic surfactant; (2) converting the cellulose-adsorbed or coated microdroplets into toner polymer particles by polymerizing the addition monomers through heating; and (3) treating the resultant toner polymer particles with a suitable silane reagent. The core forming free radical polymerization is generally conducted in a temperature range of from about 30° C. to over about 120° C., and preferably from about 45° C. to about 90° C., for an effective period of time, for example of from about 1 to about 24 hours, depending primarily on the monomers and free radical initiators used. The core resin obtained via free radical polymerization together with the optional preformed polymer resin comprises from about 80 to about 98 percent by weight of toner, the colorant comprises from about 1 to about 15 percent by weight of toner, while the silane-modified cellulose coating comprises from about 0.01 to about 5 percent by weight of the toner in embodiments thereof. More specifically, the toner core can be comprised of a resin or resins as illustrated herein in an amount of from about 80 to about 98 percent, and preferably in an amount of from about 85 to about 95 percent. There can also be added to the core a preformed polymer resin as illustrated herein in an amount of from 0 to about 50 weight percent, provided the total amount of combined resins represent from about 80 to about 98 weight percent of toner in embodiments.

Examples of core resins obtained via free radical polymerization of addition monomers include, for example, acrylic, methacrylic, styryl, and known olefinic polymers. Examples of suitable addition monomers for the free radical polymerization are preferably selected from the group consisting of methyl acrylate, methyl methacrylate, ethyl acrylate, ethyl methacrylate, propyl acrylates, propyl methacrylates, butyl acrylates, butyl methacrylates, pentyl acrylates, pentyl methacrylates, hexyl acrylates, hexyl methacrylates, heptyl acrylates, heptyl methacrylates, octyl acrylates, octyl methacrylates, cyclohexyl acrylate, cyclohexyl methacrylate, lauryl acrylates, lauryl methacrylates, stearyl acrylates, stearyl methacrylates, benzyl acrylate, benzyl methacrylate, ethoxypropyl acrylate, ethoxypropyl methacrylate, methylbutyl acrylates, methylbutyl methacrylates, ethylhexyl acrylates, ethylhexyl methacrylates, methoxybutyl acrylates, methoxybutyl methacrylates, cyanobutyl acrylates, cyanobutyl methacrylates, tolyl acrylate, tolyl methacrylate, styrene, substituted styrenes, other substantially equivalent addition monomers, and other known addition monomers, reference for example U.S. Pat. No. 4,298,672, the disclosure of which is totally incorporated herein by reference, and mixtures thereof.

Various known colorants may be selected for the toner compositions of the present invention provided, for example, that they do not interfere with the shell forming and core resin forming polymerization reactions. Typical examples of specific colorants present in an effective amount of, for example, from about 2 to about 10 weight percent of toner, include carbon black, such as VULCAN TM carbon black, REGAL 330® carbon black, and the like, PALIOGEN VIOLET 5100 TM and 5890 TM (BASF), NORMANDY MAGENTA RD-2400 TM (Paul Uhlich), PERMANENT VIOLET VT2645 TM (Paul Uhlich), HELIOGEN GREEN L8730 TM (BASF), ARGYLE GREEN XP-111-S TM (Paul Uhlich), BRILLIANT GREEN TONER GR 0991 TM (Paul Uhlich), LITHOL SCARLET D3700 TM (BASF), TOLUIDINE RED TM (Aldrich), SCARLET THERMOPLAST NSD RED TM (Aldrich), LITHOL RUBINE TONER TM (Paul Uhlich), LITHOL SCARLET 4440 TM (BASF), BON RED C TM (Dominion Color), ROYAL BRILLIANT RED RD-8192 TM (Paul Uhlich), ORACET PINK RF TM (Ciba Geigy), PALIOGEN RED 3340 TM and 3871K TM (BASF), LITHOL FAST SCARLET L4300 TM (BASF), HELIOGEN BLUE D6840 TM, D7080 TM, K6902 TM, K6910 TM and L7020 TM (BASF), SUDAN BLUE OS TM (BASF), NEOPEN BLUE FF4012 TM (BASF), PV FAST BLUE B2G01 TM (American Hoechst), IRGALITE BLUE BCA TM (Ciba Geigy), PALIOGEN BLUE 6470 TM (BASF), Sudan II TM, III TM and IV TM (Matheson, Coleman, Bell), SUDAN ORANGE TM (Aldrich), SUDAN ORANGE 220 TM (BASF), PALIOGEN ORANGE 3040 TM (BASF), ORTHO ORANGE OR 2673 TM (Paul Uhlich), PALIOGEN YELLOW 152 TM and 1560 TM (BASF), LITHOL FAST YELLOW 0991K TM (BASF), PALIOTOL YELLOW 1840 TM (BASF), NOVAPERM YELLOW FGL TM (Hoechst), PERMANENT YELLOW YE 0305 TM (Paul Uhlich), LUMOGEN YELLOW D0790 TM (BASF), SUCO-GELB L1250 TM (BASF), SUCO-YELLOW D1355 TM (BASF), SICO FAST YELLOW D1355 TM and D1351 TM (BASF), HOSTAPERM PINK E TM (Hoechst), FANAL PINK D4830 TM (BASF), CINQUASIA MAGENTA TM (DuPont), PALIOGEN BLACK L0084 TM (BASF), PIGMENT BLACK K801 TM (BASF) and carbon blacks such as CARBON BLACK 5250 TM and 5750 TM (available from Columbian Chemicals).

Various cellulose surfactants may be selected for use in the stabilization of microdroplets during the dispersion step. These cellulose surfactant molecules adsorb and subsequently precipitate on the microdroplets leading to the formation of a thin cellulose layer on the microdroplets. Suitable cellulose surfactants that can be selected include, alkyl celluloses, like methyl cellulose, ethyl cellulose, hydroxyethyl cellulose, hydroxypropyl cellulose, TYLOSE ® or hydroxyethylmethyl cellulose, hydroxypropylmethyl cellulose, and the like. The effective concentration of the cellulose surfactant in the aqueous medium ranges, for example, from about 0.1 percent by weight to about 5 percent by weight, with the preferred amount being determined primarily by the nature of the toner precursor materials and the desired toner particle size of, for example, 2 microns to about 20 microns, and preferably from about 3 to about 11 microns. In embodiments, inorganic surfactants may also be utilized in combination with the cellulose surfactant for achieving a smaller microdroplet size of, for example, less than 9 microns. Illustrative examples of suitable inorganic surfactants include alkali metal sulfates and the like, such as barium sulfate, lithium phosphate, tricalcium phosphate, potassium oleate, potassium caprate, potassium stearate, sodium laurate, sodium dodecyl sulfate, sodium oleate, sodium laurate, colloidal silica, and the like. The effective concentration of inorganic surfactant that is generally employed is, for example, from about 0.005 to about 1.0 percent by weight, and preferably from about 0.01 to about 0.20 percent by weight of the toner. Suitable free-radical initiators selected for the preparation of the toners of the present invention include azo-type initiators such as 2-2'-azobis(dimethylvaleronitrile), azobis(isobutyronitrile), azobis(cyclohexanenitrile), azobis(methylbutyronitrile), mixtures thereof, and the like; peroxide initiators such as benzoyl peroxide, lauroyl peroxide, methyl ethyl ketone peroxide, isopropyl peroxycarbonate, 2,5-dimethyl-2,5-bis(2-ethylhexanoylperoxy)hexane, di-tert-butyl peroxide, cumene hydroperoxide, dichlorobenzoyl peroxide, and mixtures thereof; with the quantity of initiator being, for example, from about 0.1 percent to about 10 percent by weight of that of core monomers.

The silane surface modification can be accomplished after the toner particles have been formed, that is after the free radical polymerization. The toner particles obtained from the free radical polymerization step can be washed several times with water to remove excess cellulose surfactant, and then can be treated with silane reagent in the presence of an acid or base catalyst, preferably in an aqueous alcoholic medium. Specifically, the toner particles are stirred in an aqueous or aqueous alcohol, like ethanol, medium containing about 0.5 to about 5 weight percent of a suitable silane reagent. A catalytic amount of an amine or acid is generally employed to increase the rate of hydrolysis of the silane reagent, and its subsequent condensation reaction with the cellulose coating of the toner particles. Thereafter, the treated toner particles are washed several times with water, and then dried at an elevated temperature ranging from 40° C. to about 120° C. for 5 to about 24 hours. The condensation or curing of the silane reagent is particularly facile at elevated temperatures. The silane-treated toner particles can also be isolated by conventional spray or freeze drying methods. Other methods of silane treatment known in the art of silane coupling reactions, such as, for example, spraying a mist of liquid silane reagent onto air suspended toner particles in a fluidized bed at elevated temperatures, can also be selected. The resulting silane-modified cellulose coating of the present invention generally have an effective thickness of, for example, from about 2 Angstroms to in excess of about 0.5 micron, and up to 1 micron in embodiments.

Illustrative examples of suitable silane reagents that can be selected for the toner surface modification of the present invention include methyltrimethoxysilane, ethyltrimethoxysilane, propyltrimethoxysilane, butyltrimethoxysilane, hexytrimethoxysilane, amyltriethoxysilane, cyclohexymethyltrichlorosilane, dodecyltriethoxysilane, decyltrichlorosilane, phenyltrimethoxysilane, 2-cyanoethyltriethoxysilane, 3-bromopropylmethyldimethoxysilane, 3-aminopropylmethyldiethoxysilane, 3-aminopropyldimethylethoxysilane, 3-aminopropyltrimethoxysilane, 3-aminopropyltriethoxysilane, 4-aminobutyltrimethoxysilane, 4-aminobutyltriethoxysilane, 3-(2-aminoethylamino)propyltrimethoxysilane, hexamethyldisilazane, 3-(6-aminohexylamino)propyltrimethoxysilane, 3-aminopropyltris(trimethylsiloxy)silane, 1,2-bis(trimethoxysilyl)ethane, 1,6-bis(trimethoxysilyl)hexane, 1,5-dichlorohexamethyltrisiloxane, 1,7-dichlorooctamethyltetrasiloxane, 3-(N,N-dimethylamino)propyltrimethoxysilane, and the like.

Surface additives can be selected for the toners of the present invention including, for example, metal salts, metal salts of fatty acids, colloidal silicas, powdered metal oxides, mixtures thereof, and the like, which additives are usually present in an amount of from about 0.1 to about 5 weight percent, reference U.S. Pat. Nos. 3,590,000; 3,720,617; 3,655,374 and 3,983,045, the disclosures of which are totally incorporated herein by reference. Preferred additives include zinc stearate, AEROSIL ® and powdered metal oxides.

Charge control additives can also be employed on the surface of toners to control their triboelectric charging characteristics. Illustrative examples of known charge control additives include powdered metal oxides, metal salts, metal salts of fatty acids, colloidal silicas, quaternary ammonium salts, sulfonamides, sulfonimides, metal complexes, organometallic complexes, mixtures thereof, and the like. For negative toners, the organoaluminum, boron, chromium, and zinc complexes or salts of salicylic acids, catechols, and the like can preferably be selected as the surface charge control additives.

For two component developers, known carrier particles including steel ferrites, copper zinc ferrites, and the like, with or without coatings, can be admixed, for example, from about 1 to about 5 parts of toner per about 100 parts of carrier with the encapsulated toners of the present invention, reference for example the carriers illustrated in U.S. Pat. Nos. 4,937,166; 4,935,326; 4,883,736; 4,560,635; 4,298,672; 3,839,029; 3,847,604; 3,849,182; 3,914,181; 3,929,657 and 4,042,518, the disclosures of which are totally incorporated herein by reference.

The toners of the present invention and developers thereof can be utilized in various imaging systems as mentioned herein including, more specifically, those wherein latent images are developed on an imaging member, such as those illustrated in U.S. Pat. Nos. 4,265,990; 4,585,884; 4,584,253 and 4,563,408, the disclosures of which are totally incorporated herein by reference, subsequently transferred to a supporting substrate and affixed thereto by thermal energy.

The following examples are being submitted to further define various species of the present invention. These examples are intended to be illustrative only and are not intended to limit the scope of the present invention. Coating thickness was determined by TEM (Tunneling Electron Microscopy).

EXAMPLE I

A 6.2 micron (volume average particle diameter) cyan toner surface modified with aminopropyltrimethoxysilane was prepared as follows.

A mixture of 100 grams of isobutyl methacrylate and 2.0 grams of HELIOGEN BLUE TM pigment was ball milled in a reaction vessel for 24 hours. To this mixture were added 1.5 grams each of 2,2'-azobis-(2,4-dimethylvaleronitrile) and 2,2'-azobis-(isobutyronitrile), and the mixture was roll milled until all the aforementioned free radical initiators were dissolved. The resulting mixture was transferred to a 2-liter reaction vessel containing 500 milliliters, 1.0 percent, of an aqueous TYLOSE ® solution containing 0.25 gram of sodium dodecyl sulfate, and was homogenized for 1 minute using a Brinkmann polytron operating at 10,000 rpm. Thereafter, the mixture was heated to 85° C. over a period of 1 hour, and maintained at this temperature for another 8 hours before cooling down to room temperature, about 25° C. The resulting toner product was washed repeatedly with water until the aqueous phase was clear, and the toner was then stirred in 500 milliliters, 20 percent (by volume), of an aqueous methanol solution containing 10 grams of 3-aminopropyltrimethoxysilane for 30 minutes. The mixture was then centrifuged, and the supernatant was decanted off. The residue was washed with water, and centrifuged again to facilitate the separation of the toner particles from water. The washing was repeated twice before the toner product was suspended in 500 milliliters of water, and spray dried in a Yamato Spray Dryer at an air inlet temperature of 160° C., and an air outlet temperature of 80° C. The air flow was maintained at 0.75 $m^3$/minute, while the atomizing air pressure was retained at 1.0 kilogram/$cm^2$. The resulting silane-treated toner product with a coating thickness of about 0.01 micron evidenced a volume average particle diameter of 6.2 microns, and a particle size distribution of 1.35 according to Coulter Counter measurements.

Fifty (50.0) grams of the toner obtained were dry blended with 0.30 gram of conductive tin oxide powder for 10 minutes using a Grey blender with its blending impeller operating at 2,500 rpm. A negatively charged developer was prepared by blending 2 parts by weight of the toner obtained with 98 parts by weight of Xerox Corporation 9200 TM carrier particles comprised of a ferrite core coated with a terpolymer of methylmethacrylate, styrene, and vinyl triethoxy polymer, 0.7 percent weight coating, reference U.S. Pat. Nos. 3,467,634 and 3,526,533, the disclosures of which are totally incorporated herein by reference. The resulting toner displayed a triboelectric value of −17.4 microcoulombs per gram as determined in the known Faraday Cage apparatus. Also, it is believed that excellent images can be generated with the aforementioned developer, and wherein the latent images were initially formed in an experimental xerographic imaging device with a layered photoconductive imaging member comprised of a trigonal selenium photogenerating layer deposited on an aluminum substrate, and as a top layer an aryl amine N,N-diphenyl-N,N'-bis(3-methylphenyl)-1,1'-biphenyl-4,4'-diamine charge transport, and subsequent to the development of images with the aforementioned prepared toner the images can be transferred to a paper substrate and fixed with heat, about 160° C., with a Viton fuser roll.

EXAMPLE II

A 3.9 micron magenta toner surface modified with butyltrimethoxysilane was prepared as follows.

A mixture of 70.0 grams of n-butyl methacrylate, 30.0 grams of styrene, and 5.0 grams of FANAL PINK TM pigment was ball milled in a suitable vessel for 24 hours. Thereafter, 3.0 grams of 2,2'-azobis(isobutyronitrile) was added, and the mixture was roll milled until all the free radical initiator was dissolved. The resulting mixture was transferred to a 2-liter reaction vessel containing 500 milliliters of a 1.0 percent aqueous hydroxyethylmethyl cellulose solution containing 0.75 gram of sodium dodecyl sulfate, and was homogenized for 1 minute using a Brinkmann polytron operating at 10,000 rpm. Thereafter, the reaction mixture was heated to 85° C. over a period of 1 hour, and maintained at this temperature for another 10 hours before cooling down to room temperature. The resulting toner particle product was washed repeatedly with water until the aqueous phase was clear, and was then stirred in 500 milliliters, 40 percent (by volume), of aqueous methanol solution containing 10 grams of butyltrimethoxysilane at a PH value of about 4.5 for 20 minutes. The PH of 4.5 was achieved by adding acetic acid to the aqueous methanol medium. Thereafter, the silane-treated toner product was isolated according to the procedure of Example I. The resulting toner product with a coating thickness of about 0.2 micron evidenced a volume average particle diameter of 3.9 microns, and a particle size distribution of 1.29 according to Coulter Counter measurements.

Fifty (50.0) grams of the toner obtained were dry blended with 0.10 gram of the powdered charge additive BONTRON E-88 TM, an aluminum complex obtained from Hodogaya Chemicals of Japan, for 10 minutes using a Greey blender with its blending impeller operating at 2,500 rpm. Thereafter, a negatively charged developer was prepared by blending 2 parts by weight of the toner obtained with 98 parts by weight of Xerox Corporation 9200 TM carrier particles, reference Example I. The toner had a triboelectric value of −19.1 microcoulombs per gram as determined in a Faraday Cage apparatus. When the aforementioned developer is incorporated into the xerographic imaging test fixture of Example I, it is believed that substantially similar results can be obtained.

EXAMPLE III

A 5.5 micron yellow toner surface modified with aminopropyltriethoxysilane was prepared by the following procedure.

A mixture of 85 grams of isobutyl methacrylate, 15.0 grams of SPAR II TM polyester, 6.0 grams of SICOFAST YELLOW TM pigment, and 10 milliliters of methylene chloride was ball milled for 24 hours. Thereafter, 4.5 grams of 2,2'-azobis-(isobutyronitrile) was added, and the mixture was roll milled until all the free radical initiator was dissolved. The mixture was transferred to a 2-liter reaction vessel containing 500 milliliters, 1.0 percent, of aqueous TYLOSE® solution containing 0.38 gram of sodium dodecyl sulfate, and homogenized for 1 minute using a Brinkmann polytron operating at 10,000 rpm. The mixture was subsequently heated to 85° C. over a period of 1 hour, and maintained at this temperature for another 10 hours before cooling down to room temperature. Thereafter, the toner particle product was washed repeatedly with water until the aqueous phase was clear, and was then stirred in 500 milliliters, 10 percent aqueous, ethanol solution containing 10 grams of 3-aminopropyltriethoxysilane for 20 minutes. The silane-treated particle product was then isolated according to the procedure of Example I. The resulting toner product with a coating thickness of about 0.002 micron evidenced a volume average particle diameter of 5.5 microns, and a particle size distribution of 1.34 according to Coulter Counter measurements.

Fifty grams of the toner obtained were dry blended with 0.50 gram of AEROSIL R812 TM powder solution coated with 20 weight percent of BONTRON E-88 TM, and a negatively charged developer was prepared by repeating the procedure of Example I. The toner displayed a triboelectric value of −15.8 microcoulombs per gram.

EXAMPLE IV

A 9.1 micron cyan toner surface modified with (2-aminoethylamino)propyltrimethoxysilane was prepared as follows.

A mixture of 50 grams of n-butyl methacrylate, 50.0 grams of styrene, and 2.5 grams of HELIOGEN BLUE K7090 TM pigment was ball milled for 24 hours. To this mixture were added 1.5 grams each of 2,2'-azobis-(2,4-dimethylvaleronitrile) and 2,2'-azobis-(isobutyronitrile), and the mixture was roll milled until all the free radical initiators were dissolved. The resulting mixture was transferred to a 2-liter reaction vessel containing 500 milliliters, 1.0 percent, of aqueous TYLOSE® solution, and was homogenized for 1 minute using a Brinkmann polytron operating at 10,000 rpm. Thereafter, the mixture was heated to 85° C. over a period of 1 hour, and maintained at this temperature for another 8 hours before cooling down to room temperature. The resulting toner particle product was washed repeatedly with water until the aqueous phase was clear, and was then stirred in 500 milliliters, 30 percent (by volume), of aqueous ethanol solution containing 10 grams of 3-(2-aminoethylamino)propyltrimethoxy silane for 20 minutes. Thereafter, the silane-treated toner product was isolated according to the procedure of Example I. The toner product evidenced a volume average particle diameter of 9.1 microns, and a particle size distribution of 1.29 according to Coulter Counter measurements.

Fifty (50.0) grams of the toner obtained was dry blended with 0.10 gram of powder BONTRON E-84 TM, and a negatively charged developer was prepared by repeating the procedure of Example I. The toner displayed a triboelectric value of −16.9 microcoulombs per gram.

EXAMPLE V

A 4.5 micron yellow toner surface modified with aminopropyltrimethoxysilane was prepared by the following procedure.

A mixture of 80 grams of isobutyl methacrylate, 10.0 grams of poly(butyl methacrylate), 6.5 grams of SICOFAST YELLOW TM pigment, and 10 milliliters of methylene chloride was ball milled for 24 hours. Thereafter, 3.0 grams of 2,2'-azobis-(isobutyronitrile) was added, and the mixture was roll milled until all the free radical initiator was dissolved. The mixture was transferred to a 2-liter reaction vessel containing 500 milliliters, 1.0 percent, of aqueous TYLOSE® solution containing 0.65 gram of sodium dodecyl sulfate, and homogenized for 1 minute using a Brinkmann polytron operating at 10,000 rpm. The mixture was subsequently heated to 85° C. over a period of 1 hour, and maintained at this temperature for another 10 hours before cooling down to room temperature. The resulting toner particle product was washed repeatedly with water until the aqueous phase was clear, and was then stirred in 500 milliliters, 10 percent, of aqueous ethanol solution containing 10 grams of 3-aminopropyltriethoxysilane for 20 minutes. Thereafter, the silanetreated toner product was then isolated according to the procedure of Example I. The resulting toner product with a coating thickness of 0.001 microns evidenced a volume average particle diameter of 4.5 microns, and a particle size distribution of 1.31 according to Coulter Counter measurements.

Fifty grams of the toner obtained were dry blended with 1.0 gram of powdered BONTRON E-88 TM, an aluminum salt obtained from Hodogaya Chemicals of Japan and a negatively charged developer was prepared by repeating the procedure of Example I. The toner displayed a triboelectric value of −17.2 microcoulombs per gram.

Other modifications of the present invention may occur to those skilled in the art based upon a review of the present application and these modifications, including equivalents, thereof, are intended to be included within the scope of the present invention.

WHAT IS CLAIMED IS:

1. A toner composition comprised of a homogeneous or substantially homogeneous mixture of polymer resin or resins, and color pigments, dyes, or mixtures thereof overcoated with a component derived from the condensation reaction of a cellulose polymer with a silane component.

2. A toner composition comprised of a core comprised of polymer resin or resins, and pigment, and thereover a coating comprised of a cellulose polymer chemically treated with a silane component.

3. A toner in accordance with claim 1 wherein the polymer resin or resins are selected from the group consisting of styrene polymers, acrylate polymers, methacrylate polymers, and polyesters.

4. A toner in accordance with claim 1 wherein the polymer resin is derived from the polymerization of addition monomer or monomers selected from the group consisting of methyl acrylate, methyl methacrylate, ethyl acrylate, ethyl methacrylate, propyl acrylates, propyl methacrylates, butyl acrylates, butyl methacrylates, pentyl acrylates, pentyl methacrylates, hexyl acrylates, hexyl methacrylates, heptyl acrylates, heptyl methacrylates, octyl acrylates, octyl methacrylates, cyclohexyl acrylate, cyclohexyl methacrylate, lauryl acrylates, lauryl methacrylates, stearyl acrylates, stearyl methacrylates, benzyl acrylate, benzyl methacrylate, ethoxypropyl acrylate, ethoxypropyl methacrylate, methylbutyl acrylates, methylbutyl methacrylates, ethylhexyl acrylates, ethylhexyl methacrylates, methoxybutyl acrylates, methoxybutyl methacrylates, cyanobutyl acrylates, cyanobutyl methacrylates, tolyl acrylate, tolyl methacrylate, styrene, methylstyrene, hexylstyrene, dodecylstyrene, and nonyl styrene.

5. A toner in accordance with claim 1 wherein cyan, yellow, magenta, red, green, blue, brown dyes, pigments, or mixtures thereof are selected.

6. A toner in accordance with claim 1 wherein the cellulose polymer is selected from the group consisting of methyl cellulose, ethyl cellulose, hydroxyethyl cellulose, hydroxypropyl cellulose, hydroxyethylmethyl cellulose, and hydroxypropylmethyl cellulose.

7. A toner in accordance with claim 1 wherein the silane component is selected from the group consisting of methyltrimethoxysilane, ethyltrimethoxysilane, propyltrimethoxysilane, butyltrimethoxysilane, hexytrimethoxysilane, amyltriethoxysilane, cyclohexymethyltrichlorosilane, dodecyltriethoxysilane, decyltrichlorosilane, phenyltrimethoxysilane, 2-cyanoethyltriethoxysilane, 3-bromopropylmethyldimethoxysilane, 3-aminopropylmethyldiethoxysilane, 3-aminopropyldimethylethoxysilane, 3-aminopropyltrimethoxysilane, 3-aminopropyltriethoxysilane, 4-aminobutyltrimethoxysilane, 4-aminobutyltriethoxysilane, 3-(2-aminoethylamino)-propyltrimethoxysilane, hexamethyldisilazane, 3-(6-aminohexylamino)propyltrimethoxysilane, 3-aminopropyltris(trimethylsiloxy)silane, 1,2-bis(trimethoxysilyl)ethane, 1,6-bis(trimethoxysilyl)hexane, 1,5-dichlorohexamethyltrisiloxane, 1,7-dichlorooctamethyltetrasiloxane, and 3-(N,N-dimethylamino)propyltrimethoxysilane.

8. A toner in accordance with claim 2 wherein the silane component is selected from the group consisting of methyltrimethoxysilane, ethyltrimethoxysilane, propyltrimethoxysilane, butyltrimethoxysilane, hexytrimethoxysilane, amyltriethoxysilane, cyclohexymethyltrichlorosilane, dodecyltriethoxysilane, decyltrichlorosilane, phenyltrimethoxysilane, 2-cyanoethyltriethoxysilane, 3-bromopropylmethyldimethoxysilane, 3-aminopropylmethyldiethoxysilane, 3-aminopropyldimethylethoxysilane, 3-aminopropyltrimethoxysilane, 3-aminopropyltriethoxysilane, 4-aminobutyltrimethoxysilane, 4-aminobutyltriethoxysilane, 3-(2-aminoethylamino)-propyltrimethoxysilane, hexamethyldisilazane, 3-(6-aminohexylamino)propyltrimethoxysilane, 3-aminopropyltris(trimethylsiloxy)silane, 1,2-bis(trimethoxysilyl)ethane, 1,6-bis(trimethoxysilyl)hexane, 1,5-dichlorohexamethyltrisiloxane, 1,7-dichlorooctamethyltetrasiloxane, and 3-(N,N-dimethylamino)propyltrimethoxysilane.

9. A toner in accordance with claim 2 containing surface additives comprised of fine powders of conductive metal oxides, metal salts, metal salts of fatty acids, colloidal silicas, titanates, quaternary ammonium salts, metal complexes, organometallic complexes, or mixtures thereof.

10. A toner in accordance with claim 9 wherein the surface additives comprise a mixture of a colloidal silica or titanate, and an organoaluminum, organoboron, organozinc, organochromium complex of a salicylic acid or catehol.

11. A toner in accordance with claim 1 containing surface charge control additives.

12. A toner in accordance with claim 11 wherein the charge control additives are comprised of quaternary ammonium salts, conductive metal oxides, metal and organometallic salts.

13. A process for the preparation of toner compositions which comprises forming a stable oil-in-water microdroplet suspension consisting of a mixture of addition monomers, free radical initiators, optional preformed polymer resins, and colorants in an aqueous medium containing a cellulose surfactant and an optional inorganic surfactant; polymerizing the addition monomers, thereby converting the microdroplets into polymer particles; modifying the polymer particle's surface with a silane reagent; and subsequently applying surface additives to the silane-modified polymer particles.

14. A process in accordance with claim 13 wherein the polymerizations are accomplished at a temperature of from about 30° C. to about 120° C.

15. An imaging process which comprises the generation of an image on an imaging surface, subsequently developing this image with the toner composition of claim 1, thereafter transferring the image to a suitable substrate, and permanently affixing the image thereto.

16. An imaging process which comprises the generation of an image on an imaging surface, subsequently developing this image with the toner composition of claim 2, thereafter transferring the image to a suitable substrate, and permanently affixing the image thereto.

17. An imaging method in accordance with claim 15 wherein fixing is accomplished by heat.

18. A process in accordance with claim 13 wherein the cellulose surfactant is selected from the group consisting of methyl cellulose, ethyl cellulose, hydroxyethyl cellulose, hydroxypropyl cellulose, hydroxyethylmethyl cellulose, and hydroxypropylmethyl cellulose.

19. A toner in accordance with claim 2 wherein the overcoating cellulose polymer is selected from the group consisting of methyl cellulose, ethyl cellulose, hydroxyethyl cellulose, hydroxypropyl cellulose, hydroxyethylmethyl cellulose, and hydroxypropylmethyl cellulose.

20. A toner composition comprised of a core comprised of polymer particles and color pigments, dyes, or mixtures thereof, overcoated with a cellulose derivative obtained from the condensation reaction of a cellulose polymer with a silane component.

* * * * *